US011839340B2

(12) United States Patent
Hodapp, Jr.

(10) Patent No.: US 11,839,340 B2
(45) Date of Patent: Dec. 12, 2023

(54) DISHWASHING APPLIANCE CLOGGED DRAIN LINE PREVENTION

(71) Applicant: Haier US Appliance Solutions, Inc., Wilmington, DE (US)

(72) Inventor: Leo Edward Hodapp, Jr., Greenville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/395,544

(22) Filed: Aug. 6, 2021

(65) Prior Publication Data

US 2023/0042630 A1 Feb. 9, 2023

(51) Int. Cl.
*A47L 15/42* (2006.01)
*A47L 15/00* (2006.01)

(52) U.S. Cl.
CPC ..... *A47L 15/4287* (2013.01); *A47L 15/001* (2013.01); *A47L 15/0007* (2013.01); *A47L 15/0028* (2013.01); *A47L 15/0031* (2013.01); *A47L 15/0049* (2013.01); *A47L 15/4223* (2013.01); *A47L 15/4225* (2013.01);
(Continued)

(58) Field of Classification Search
CPC ..... A47L 15/4287; A47L 15/0007; A47L 15/001; A47L 15/0028; A47L 15/0031; A47L 15/0049; A47L 15/4223; A47L 15/4225; A47L 15/4246; A47L 15/4285;
(Continued)

(56) References Cited

U.S. PATENT DOCUMENTS 4,159,211 A * 6/1979 Hoffman ..... A47L 15/4287 68/12.22
7,897,104 B2 * 3/2011 Kwon ..... A47L 15/0034 422/1

(Continued)

FOREIGN PATENT DOCUMENTS

CN 110840351 A 2/2020
EP 1980193 A1 10/2008

(Continued)

OTHER PUBLICATIONS

Kim (KR 20200023976 A, Machine Translation). (Year: 2022).*
Jerg et al. (EP 2449942 A2, Machine Translation). (Year: 2022).*

*Primary Examiner* — Duy Vu N Deo
*Assistant Examiner* — Christopher Remavege
(74) *Attorney, Agent, or Firm* — Dority & Manning, P.A.

(57) ABSTRACT

A dishwashing appliance includes a tub defining a wash chamber therein for receipt of articles for washing, a heating element, a sump positioned at a bottom of the wash chamber for receiving fluid from the wash chamber, a drain pump in communication with the sump, and a temperature sensor. Methods of operating the dishwashing appliance may include filling the sump with a liquid and heating the liquid by activating the heating element. Such methods also may include measuring a temperature of a liquid in the sump with the temperature sensor and comparing the measured temperature of the liquid to a minimum drain temperature threshold. Such methods may include draining the liquid from the sump after the measured temperature is equal to or greater than the minimum drain temperature threshold, such as immediately after heating the liquid.

9 Claims, 5 Drawing Sheets

(52) U.S. Cl.
CPC ..... *A47L 15/4246* (2013.01); *A47L 15/4285* (2013.01); *A47L 15/4293* (2013.01); *A47L 2301/04* (2013.01); *A47L 2401/12* (2013.01); *A47L 2501/05* (2013.01); *A47L 2501/06* (2013.01)

(58) Field of Classification Search
CPC ..... A47L 15/4293; A47L 2301/04; A47L 2401/12; A47L 2501/05; A47L 2501/06
See application file for complete search history.

(56) References Cited

U.S. PATENT DOCUMENTS

| | | | | |
|---|---|---|---|---|
| 9,226,642 | B1 * | 1/2016 | Becknell | A47L 15/0023 |
| 9,901,238 | B2 * | 2/2018 | Petri | A47L 15/0057 |
| 2013/0319458 | A1 * | 12/2013 | Lim | A47L 15/13 134/1 |
| 2017/0007093 | A1 * | 1/2017 | Casale | A47L 15/421 |
| 2019/0357749 | A1 | 11/2019 | Persson | |
| 2020/0214536 | A1 * | 7/2020 | Ross | A47L 15/4287 |
| 2020/0221923 | A1 * | 7/2020 | Persson | A47L 15/4285 |

FOREIGN PATENT DOCUMENTS

| | | | | |
|---|---|---|---|---|
| EP | 2449942 | A2 * | 5/2012 | A47L 15/0021 |
| EP | 2449942 | A2 | 5/2012 | |
| KR | 20200023976 | A * | 3/2020 | A47L 15/0021 |

* cited by examiner

DISHWASHING APPLIANCE CLOGGED DRAIN LINE PREVENTION

FIELD OF THE INVENTION

The present subject matter relates generally to dishwashing appliances, and more particularly to features and methods for preventing clogged drains in and connected to dishwashing appliances.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. After being applied or directed towards the rack assemblies and/or articles therein, the wash liquid generally flows by gravity to or towards a bottom of the wash chamber, such as to a sump positioned at the bottom of the wash chamber. Dishwashing appliances are also typically equipped with one or more pumps, such as a circulation pump or a drain pump, for directing or motivating wash liquid from the sump to, e.g., the spray assemblies or an area outside of the dishwashing appliance.

Over time, debris such as food particles, grease, and other materials which are removed from the articles during rinse and wash operations of the dishwashing appliance may accumulate on or in drain conduits, e.g., tubes or pipes, inside of or connected to the dishwashing appliance. This build up can lead to obstructions or clogs in the drain conduits, and such clogs are problematic for numerous reasons.

Accordingly, dishwashing appliances that include features for preventing and/or removing clogs in drain conduits associated therewith would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwashing appliance is provided. The dishwashing appliance includes a tub defining a wash chamber therein for receipt of articles for washing, a heating element, a sump positioned at a bottom of the wash chamber for receiving fluid from the wash chamber, a drain pump in communication with the sump, and a temperature sensor. The method includes measuring a temperature of a liquid in the sump with the temperature sensor and comparing the measured temperature of the liquid to a minimum drain temperature threshold. The method further includes draining the liquid from the sump after the measured temperature is equal to or greater than the minimum drain temperature threshold.

In another exemplary aspect of the present disclosure, a method of operating a dishwashing appliance is provided. The dishwashing appliance includes a tub defining a wash chamber therein for receipt of articles for washing, a heating element, a sump positioned at a bottom of the wash chamber for receiving fluid from the wash chamber, a drain pump in communication with the sump, and a temperature sensor. The method includes filling the sump with a liquid and heating the liquid by activating the heating element. The method further includes draining the liquid from the sump immediately after heating the liquid.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
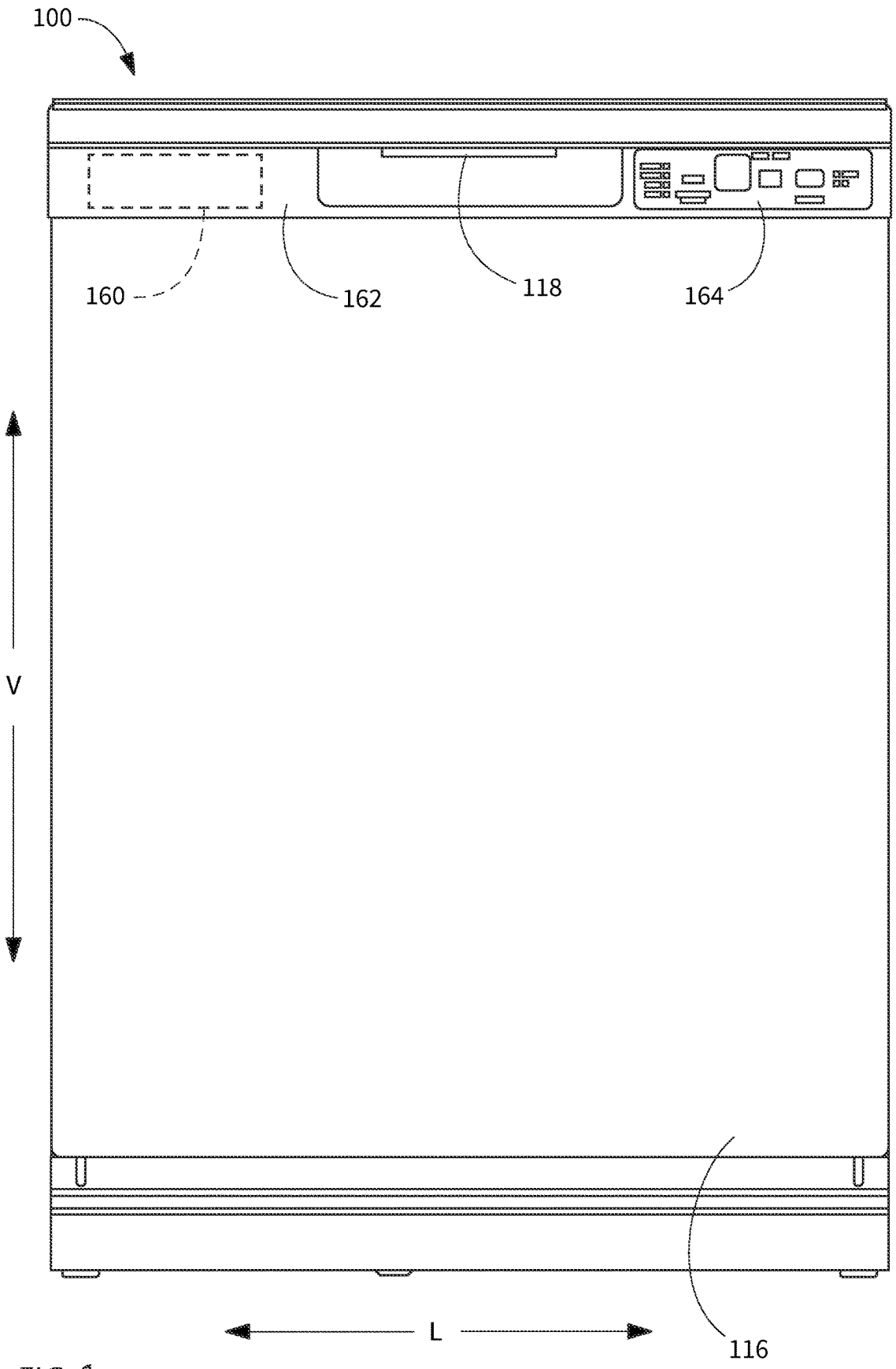
FIG. 1 provides a front view of an exemplary embodiment of a dishwashing appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is used to refer to an overall operation of the dishwashing appliance which may include two or more distinct phases. The term "wash phase" is intended to refer to one or more periods of time during which a dishwashing appliance operates while containing the articles to be washed and uses a wash liquid (e.g., water, detergent, or wash additive) and may be a portion of the wash cycle, such as a beginning or early portion of the wash cycle. The term "rinse phase" is intended to refer to one or more periods of time during which the dishwashing appliance operates to remove residual soil, detergents, and other undesirable elements that were retained by the articles after completion of the wash phase and may be a portion of the wash cycle, such as an intermediate portion of the wash cycle. The term "drain phase" is intended to refer to one or more periods of time during which the dishwashing appliance operates to discharge soiled water from the dishwashing appliance and may be a portion of the wash cycle, such as a later portion of the wash cycle. The term "wash liquid" refers to a liquid used for washing or rinsing the articles that is typically made up of water and may include additives, such as detergent or other treatments (e.g., rinse aid). Furthermore, as used herein, terms of approximation, such as "generally," "approximately," "substantially," or "about," refer to being within a ten percent (10%) margin of error. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
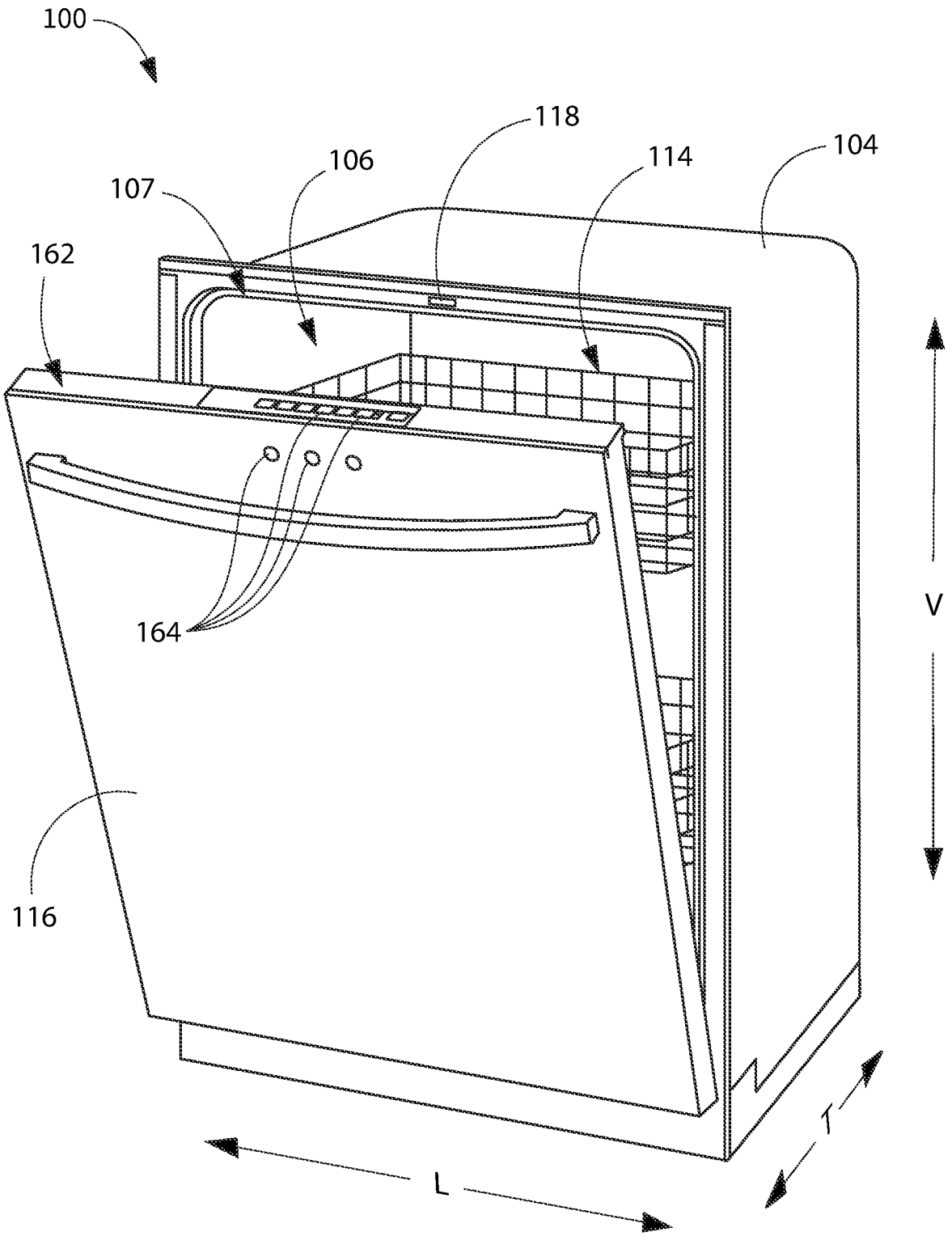
FIG. 2 provides a perspective view of an additional exemplary embodiment of a dishwashing appliance of the present disclosure with a door in an intermediate position.
Figure 3:
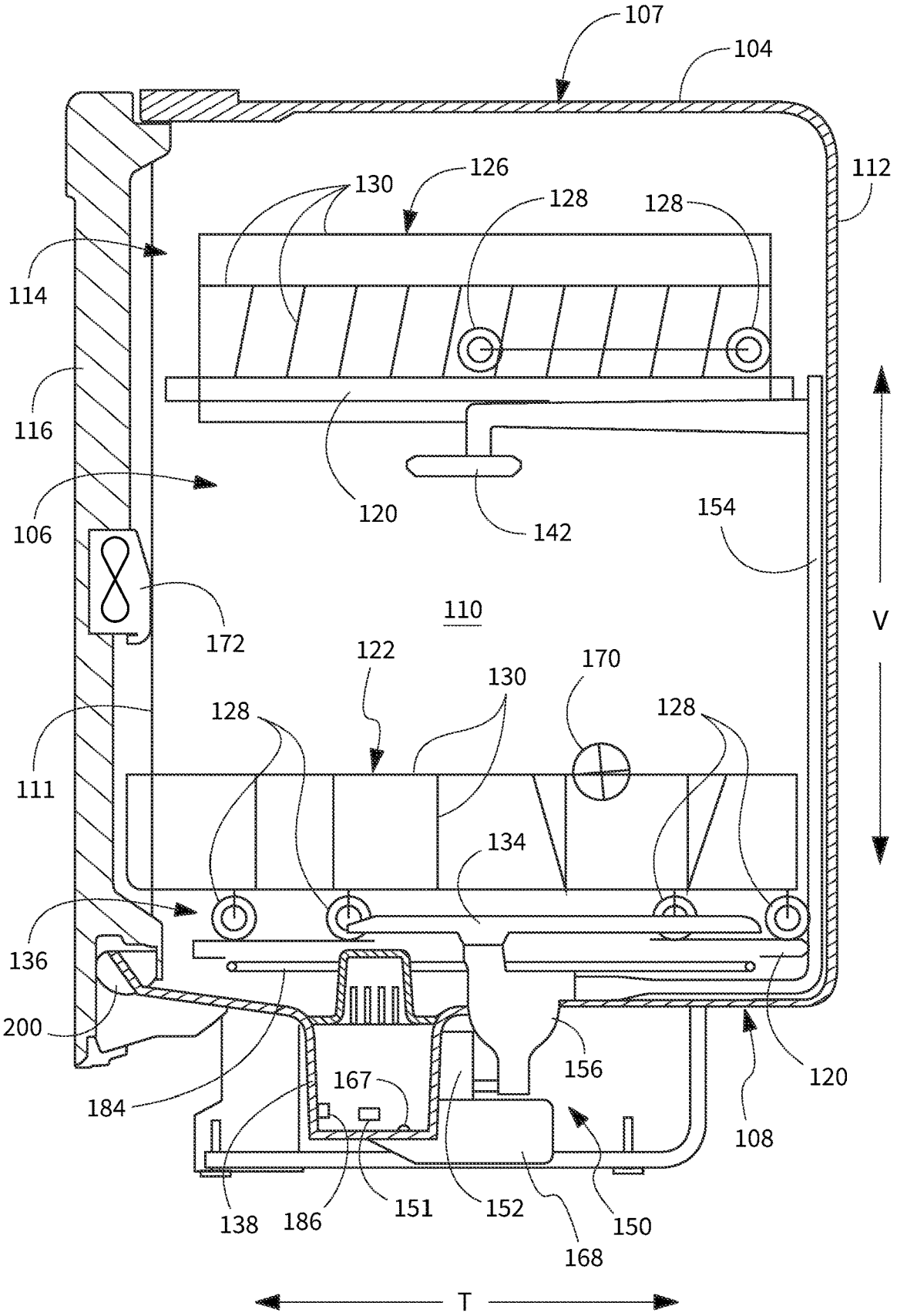
FIG. 3 provides a side, cross section view of an exemplary dishwashing appliance, such as the dishwashing appliance of FIG. 1 or FIG. 2.

Turning now to the figures, FIGS. 1 through 3 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a tub 104 that defines a wash chamber 106 therein. As shown in FIG. 3, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114 at the front side 111. In some embodiments, the dishwashing appliance 100 may also include a door 116 at the front opening 114. The door 116 may, for example, be coupled to the tub 104 by a hinge 200 at its bottom for movement between a normally closed vertical position (FIGS. 1 and 3), wherein the wash chamber 106 is sealed shut for washing operation, and a horizontal open position (not shown) for loading and unloading of articles from dishwasher 100. A door closure mechanism or assembly 118, e.g., a latch, may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122 and an upper rack assembly 126. In some such embodiments, upper rack assembly 126 is positioned at a top portion of wash chamber 106 above lower rack assembly 122 along the vertical direction V.

Generally, each rack assembly 122, 126 may be adapted for movement between an extended loading position (not shown) in which the rack is substantially positioned outside the wash chamber 106, and a retracted position (shown in FIGS. 1 through 3) in which the rack is located inside the wash chamber 106. In some embodiments, movement is facilitated, for instance, by rollers 128 mounted onto rack assemblies 122, 126, respectively.

Although guide rails 120 and rollers 128 are illustrated herein as facilitating movement of the respective rack assemblies 122, 126, it should be appreciated that any suitable sliding mechanism or member may be used according to alternative embodiments.

In optional embodiments, some or all of the rack assemblies 122, 126 are fabricated into lattice structures including a plurality of wires or elongated members 130 (for clarity of illustration, not all elongated members making up rack assemblies 122, 126 are shown). In this regard, rack assemblies 122, 126 are generally configured for supporting articles within wash chamber 106 while allowing a flow of wash liquid to reach and impinge on those articles (e.g., during a cleaning or rinsing phase of the wash cycle). According to additional or alternative embodiments, a silverware basket (not shown) may be removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash liquid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122. In this regard, lower spray arm assembly 134 may generally be configured for urging a flow of wash liquid up through lower rack assembly 122.

In some embodiments, an upper spray assembly 142 may be located proximate to and, e.g., below, upper rack assembly 126 along the vertical direction V. In this manner, upper spray assembly 142 may be generally configured for urging of wash liquid up through upper rack assembly 126.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be mounted to sump 138 and in fluid communication with the sump 138 through a circulation outlet 151 from the sump 138.

When assembled, circulation pump 152 may be in fluid communication with an external water supply line (not shown) and sump 138. A water inlet valve (not shown) can be positioned between the external water supply line and circulation pump 152 (e.g., to selectively allow water to flow from the external water supply line to circulation pump 152). Additionally or alternatively, water inlet valve can be positioned between the external water supply line and sump 138 (e.g., to selectively allow water to flow from the external water supply line to sump 138). During use, water inlet valve may be selectively controlled to open to allow the flow of water into dishwasher 100 and may be selectively controlled to close and thereby cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 3, a primary supply conduit 154 extends from circulation pump 152, along rear side 112 of tub 104 along the vertical direction V to supply wash liquid throughout wash chamber 106.

In optional embodiments, circulation pump 152 urges or pumps wash liquid to a diverter 156 (FIG. 3). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 142, or other spray manifolds or assemblies. For instance, the diverter disk may have at least one aperture configured to align with one or more outlet ports (not shown) at the top of diverter chamber 158. In this manner, the diverter disk may be selectively rotated to provide wash liquid to the desired spray device(s).

In exemplary embodiments, diverter 156 is configured for selectively distributing the flow of wash liquid from circulation pump 152 to various fluid supply conduits—only some of which are illustrated in FIG. 3 for clarity. In certain embodiments, diverter 156 includes two or more outlet ports (not shown) for supplying wash liquid to a first conduit for rotating lower spray arm assembly 134 and a second conduit for supplying upper spray assembly 142 (e.g., supply conduit 154). Additional embodiments may also include one or more additional conduits, e.g., a third conduit for spraying an auxiliary rack such as a silverware rack, etc.

In some embodiments, a supply conduit 154 is used to supply wash liquid to one or more spray assemblies (e.g., to upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, supply conduit 154 could be used to provide wash liquid to lower spray arm assembly 134 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray assembly 134 and 142, or other spray device as may be included in dishwashing appliance 100, may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 142 may be motor-driven, or may operate using any other suitable drive mechanism. Spray manifolds and assemblies may also be stationary. The resultant movement of the spray assemblies 134, 142 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

Drainage of soiled wash liquid within sump 138 may by provided, for instance, by a drain pump 168 (e.g., during or as part of a drain phase). In particular, wash liquid may exit sump 138 through a drain outlet 167 and may flow through a drain conduit or directly to the drain pump 168. Thus, drain pump 168 is downstream of sump 138 and facilitates drainage of the soiled wash liquid by urging or pumping the wash liquid to a drain line external to dishwasher 100.

In some embodiments, a filter assembly may be provided, e.g., in the sump 138 and/or at a top entrance into the sump 138, e.g., to filter fluid to circulation assembly 150 and/or drain pump 168. Generally, the filter assembly removes soiled particles from the liquid that flows to the sump 138 from the wash chamber 106 during operation of dishwashing appliance 100. In exemplary embodiments, the filter assembly may include both a first filter (also referred to as a "coarse filter") and a second filter (also referred to as a "fine filter").

Although a separate circulation pump 152 and drain pump 168 are described herein, it is understood that other suitable pump configurations (e.g., using only a single pump for both recirculation and draining) may be provided.

The dishwashing appliance 100 may further include a heating element 184, such as a resistance heating element, positioned in or near the sump 138. For example, the heating element 184 may be positioned "near" the sump 138 in that the heating element 184 is disposed above the sump 138 and within the lower region 136 of wash chamber 106, such as below the lower spray arm 134 and/or below the lower rack assembly 122. The heating element 184 may be positioned and configured to heat liquid in the sump 138, such as for a heated wash phase, and/or to heat air within the wash chamber 106, such as for drying articles during a dry phase.

Dishwashing appliance 100 may also include ventilation features, e.g., to promote improved, e.g., more rapid, drying of articles therein after the wash and rinse phases. For example, one or more vents 170 may be provided in the tub 104 for introducing relatively dry air from outside of the tub 104 into the wash chamber 106 and/or for removing relatively humid air from the wash chamber 106 to the outside of the tub 104. In some embodiments, a fan 172 may be provided. The fan 172 may be operable to urge air through the wash chamber 106, such as to promote air circulation and/or ventilation within and through the wash chamber. Such air movement may increase the rate of evaporation of moisture from articles in the wash chamber 106 after a wash and/or rinse phase.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation or wash cycle that may include a pre-wash phase, a wash phase, a rinse phase, a drain phase, and/or a dry phase. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry—such as switches, amplifiers, integrators, comparators, flip-flops, AND gates, and the like—to perform control functionality instead of relying upon software. It should be noted that controllers as disclosed herein are capable of and may be operable to perform any methods and associated method steps as disclosed herein.

Controller 160 may be positioned in a variety of locations throughout dishwasher 100. In optional embodiments, controller 160 is located within a control panel area 162 of door 116 (e.g., as shown in FIG. 1 or FIG. 2). Input/output ("I/O") signals may be routed between the control system and various operational components of dishwasher 100 along wiring harnesses that may be routed through the bottom of door 116. Typically, the controller 160 includes or is operatively coupled to a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electro-mechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

The dishwashing appliance 100 may also include a temperature sensor 186 in operative communication with the controller 160. For example, in some embodiments, the temperature sensor 186 may be located in the sump 138 and may thereby be operable to measure a temperature of a liquid, e.g., wash liquid, within the sump 138. For example, the "temperature sensor" may include any suitable type of temperature measuring system or device positioned at any suitable location for measuring the desired temperature. Thus, for example, temperature sensor 186 may be any suitable type of temperature sensor, such as a thermistor, a thermocouple, a resistance temperature detector, a semiconductor-based integrated circuit temperature sensor, etc. In addition, temperature sensor 186 may be positioned at any suitable location and may output a signal, such as a voltage, to the controller 160 that is proportional to and/or indicative of the temperature being measured. Although exemplary positioning of the temperature sensor 186 is described herein and depicted in FIG. 3, it should be appreciated that dishwashing appliance 100 may include any other suitable number, type, and position of temperature, humidity, and/or other sensors as well as or instead of the exemplary temperature sensor 186 according to alternative embodiments.

It should be appreciated that the invention is not limited to any particular style, model, or configuration of dishwasher 100. The exemplary embodiments depicted in FIGS. 1 through 3 are for illustrative purposes only. For instance, different locations may be provided for control panel area 162 (e.g., on the front of the door 116 as illustrated in FIG. 1 or on the top of the door 116 as illustrated in FIG. 2, or other locations as well), different configurations may be provided for rack assemblies 122, 126, different spray assemblies 134, 142 and spray manifold configurations may be used, different sensors may be used, and other differences may be applied while remaining within the scope of the present disclosure.

Figure 4:
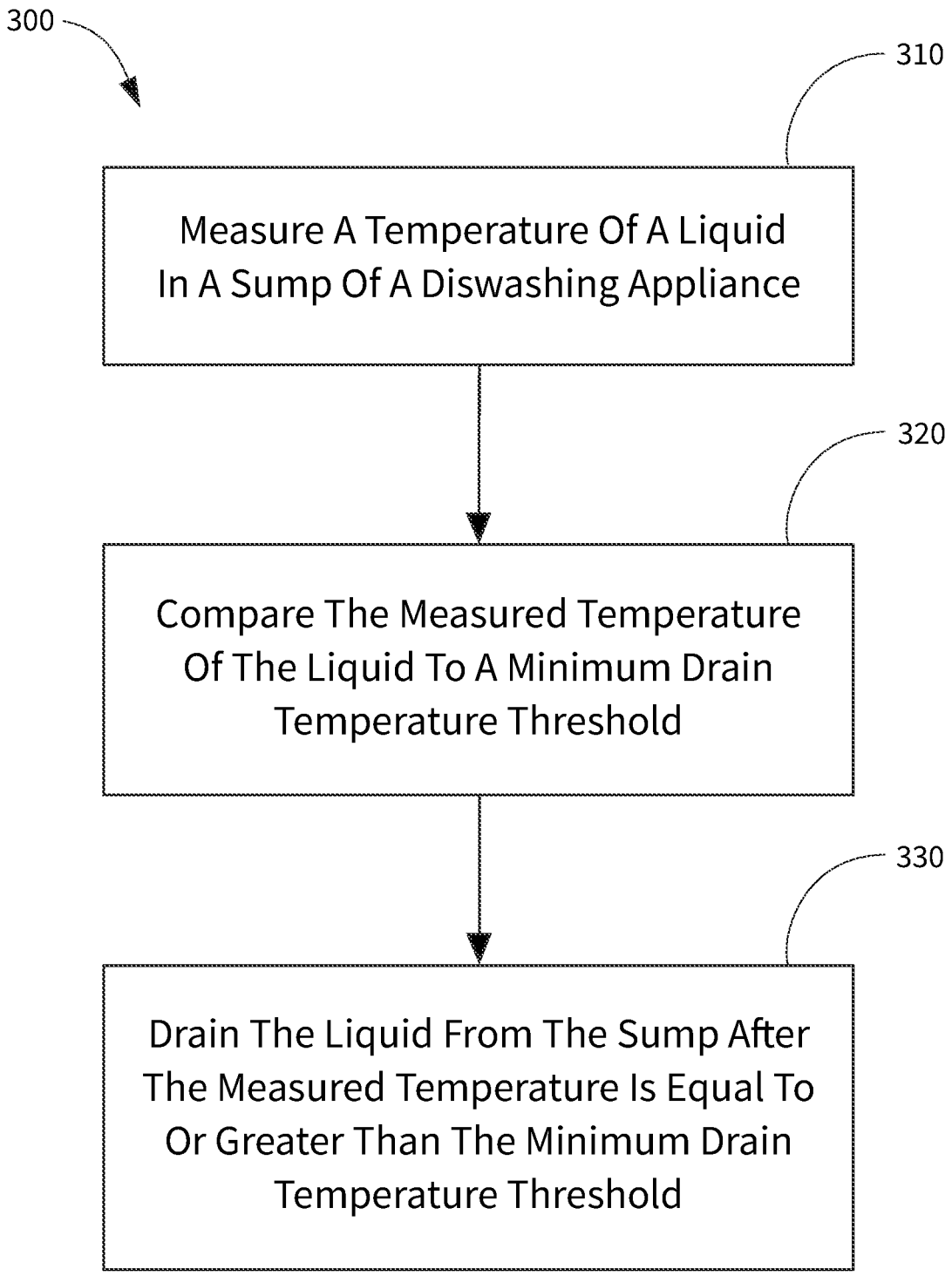
FIG. 4 provides a flow chart of a method of operating a dishwashing appliance according to one or more exemplary embodiments of the present disclosure.
Figure 5:
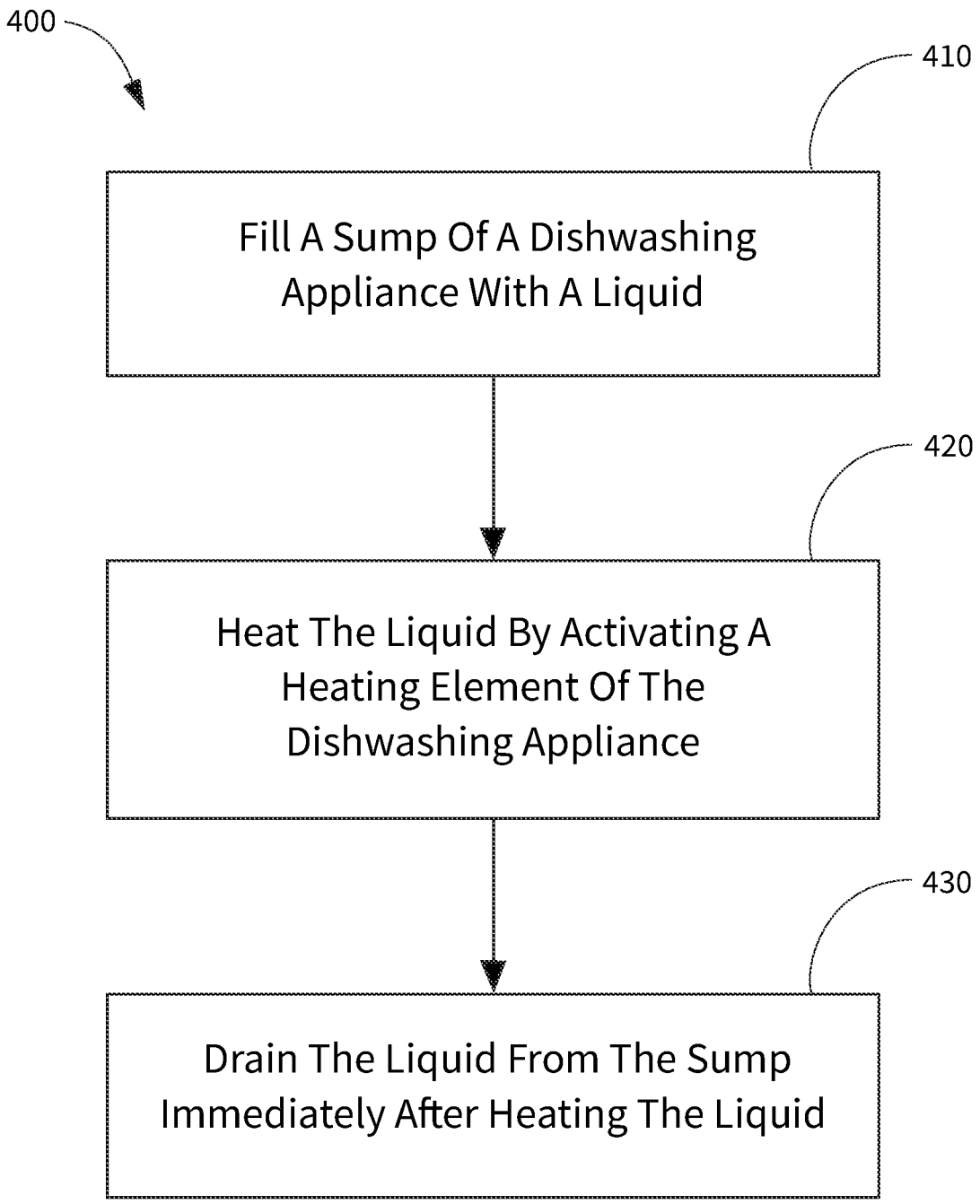
FIG. 5 provides a flow chart of a method of operating a dishwashing appliance according to one or more additional exemplary embodiments of the present disclosure.

Turning now to FIGS. 4 and 5, exemplary embodiments of the present disclosure also include methods of operating a dishwashing appliance, such as an exemplary method 300 of operating a dishwashing appliance as illustrated in FIG. 4 and/or an exemplary method 400 of operating a dishwashing appliance as illustrated in FIG. 5. Methods 300 and 400 can be implemented using any suitable appliance, including for example, dishwashing appliance 100 of FIGS. 1 through 3.

Accordingly, to provide context to methods 300 and 400, reference numerals utilized to describe the features of dishwashing appliance 100 in FIGS. 1 through 3 will be used below.

Methods 4 and 5 generally relate to flushing a drain line of the dishwashing appliance 100 and/or drain conduits downstream of the dishwashing appliance 100. In particular, such flushing may be provided with heated water (or heated wash liquid more generally) in order to promote breaking up and removal of accumulated sediment or other debris from the drain line(s) in and/or downstream of the dishwashing appliance 100. For example, the liquid may be heated by a heating element, e.g., heating element 184, of the dishwashing appliance prior to the drain, such as immediately prior to the drain. Accordingly, the methods 300 and 400 generally include a temperature-dependent drain, whereas conventional drains are temperature agnostic. For example, typical drains are time based and, where the temperature of the liquid to be drained decreases over time, generally provide a warm or cold drain. As used herein, the terms "hot" versus "warm" or "cold" may refer to liquid temperatures being above or below a temperature threshold, e.g., hot being above and warm or cold being below, where exemplary temperature thresholds (e.g., minimum drain temperature threshold) will be explained in more detail below. Moreover, conventional dishwashing appliance operations that include heating liquid within the dishwashing appliance also include additional steps, such as circulating the heated liquid during a wash phase, prior to draining the liquid. Conventionally, methods that include draining immediately after heating (e.g., without intervening steps such as using the heated water to wash articles within the dishwashing appliance) are considered as consuming excessive energy when the heated water is not circulated or otherwise used in the dishwashing appliance prior to draining.

As illustrated in FIG. 4, in some embodiments, a method 300 of operating a dishwashing appliance 100 may include a step 310 of measuring a temperature of a liquid in the sump with a temperature sensor, e.g., temperature sensor 186 as described above. The method 300 may further include a step 320 of comparing the measured temperature of the liquid to a minimum drain temperature threshold. When the measured temperature is equal to or greater than the minimum drain temperature threshold, the method 300 may then include draining the liquid from the sump. Thus, the method 300 may provide a temperature-dependent drain, wherein the draining step is performed based on, e.g., dependent upon, the liquid in the sump reaching or exceeding the minimum drain temperature threshold.

In some exemplary embodiments, the method 300 may further include heating the liquid by activating the heating element when the measured temperature is less than the minimum drain temperature threshold. For example, the liquid may be heated until it reaches a temperature of at least the minimum drain temperature threshold. In such embodiments, the method 300 may also include draining the liquid from the sump after the measured temperature is equal to or greater than the minimum drain temperature threshold is performed immediately after heating the liquid, e.g., heating the liquid to at least the minimum drain temperature threshold and then immediately draining the liquid once the liquid temperature is equal to or greater than the minimum drain temperature threshold.

As illustrated in FIG. 5, in some embodiments, a method 400 of operating a dishwashing appliance 100 may include a step 410 of filling the sump of the dishwashing appliance with a liquid. The method 400 may further include a step 420 of heating the liquid. Such heating may be provided by activating the heating element of the dishwashing appliance. Method 400 may also include draining the liquid from the sump immediately after heating the liquid. Thus, method 400 may provide a hot drain.

In some exemplary embodiments, the method 400 may further include measuring a temperature of the liquid in the sump with the temperature sensor and comparing the measured temperature of the liquid to a minimum drain temperature threshold prior to draining the liquid. In such embodiments, draining the liquid from the sump may be performed after the measured temperature is equal to or greater than the minimum drain temperature threshold, e.g., the liquid may be drained from the sump immediately after heating the liquid to at or above the minimum drain temperature threshold and in response to the liquid reaching or exceeding the minimum drain temperature threshold.

In various embodiments, the minimum drain temperature threshold may be about one hundred twenty degrees Fahrenheit or more, such as about one hundred thirty degrees Fahrenheit or more, such as about one hundred forty degrees Fahrenheit or more, such as about one hundred fifty degrees Fahrenheit or more, such as about one hundred sixty degrees Fahrenheit.

In various embodiments, the temperature-dependent drain of the present disclosure, e.g., method 300 and/or 400, may be performed at various times throughout the wash cycle, or independent of the wash cycle, e.g., as a stand-alone operation which may be initiated in response to a user selection or automatically. For example, a method of operating a dishwashing appliance according to the present disclosure may include filling the sump with the liquid and circulating the liquid through the wash chamber prior to measuring the temperature of the liquid, e.g., the liquid may be used in a wash phase or a rinse phase (or both, or more than one of either or both) and then drained at or above the minimum drain temperature threshold, which may include heating or re-heating the liquid after circulating the liquid in order to reach or exceed the minimum drain temperature threshold. In some embodiments, the wash cycle may include a pre-wash phase as the first, initial, phase of the wash cycle, e.g., prior to the wash phase, and the method may be performed during the pre-wash phase of a wash cycle. Performing the method during the pre-wash phase may be advantageous in that the soil buildup is highest during the pre-wash phase and the pre-set operating temperatures during the pre-wash phase are lowest, as compared to the rest of the wash cycle. In additional embodiments, the method may be performed after a pre-wash phase of a wash cycle and before a dry phase of the wash cycle. For example, some embodiments may include filling the sump with liquid, heating the liquid in the sump, then circulating the liquid through the wash chamber, e.g., in a pre-wash phase, followed by reheating the liquid after circulation, e.g., the pre-wash phase, and then immediately draining the reheated liquid, e.g., without circulating or otherwise using the reheated liquid prior to draining.

In some embodiments, the method may be performed automatically. For example, the dishwashing appliance may automatically perform the temperature-dependent drain method, e.g., method 300 and/or 400, periodically, such as after a predetermined number N of wash cycles. As another example, the dishwashing appliance 100 may be configured to detect a slow drain time which may be indicative of potential clogging of the drain line. The slow drain time may be detected based on one or more of: water flow rate, water level detection, and/or drain pump current. In additional embodiments, the method may also or instead be performed in response to a user input, e.g., received via one of the controls 164. The temperature-dependent drain method may be selectable as an option within a predetermined cycle, such as a wash cycle for washing articles in the dishwashing appliance or a clean cycle which may include, e.g., cleaning or backwashing the filter assembly, and/or as a stand-alone operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance, the dishwashing appliance comprising a tub defining a wash chamber therein for receipt of articles for washing, a heating element, a sump positioned at a bottom of the wash chamber for receiving fluid from the wash chamber, a drain pump in communication with the sump, and a temperature sensor, the method comprising:

measuring a temperature of a liquid in the sump with the temperature sensor;

comparing the measured temperature of the liquid to a minimum drain temperature threshold, wherein comparing the measured temperature of the liquid to the minimum drain temperature threshold comprises determining the measured temperature is less than the minimum drain temperature threshold;

heating the liquid by activating the heating element in response to determining the measured temperature is less than the minimum drain temperature threshold; and draining the liquid from the sump after the measured temperature is equal to or greater than the minimum drain temperature threshold, wherein draining the liquid from the sump after the measured temperature is equal to or greater than the minimum drain temperature threshold is performed immediately after heating the liquid, wherein the method is a stand-alone operation independent of a wash cycle of the dishwashing appliance.

2. The method of claim 1, wherein the method is performed automatically.

3. The method of claim 1, wherein the method is performed in response to a user input.

4. The method of claim 1, wherein the minimum drain temperature threshold is at least about one hundred twenty degrees Fahrenheit.

5. A method of operating a dishwashing appliance, the dishwashing appliance comprising a tub defining a wash chamber therein for receipt of articles for washing, a heating element, a sump positioned at a bottom of the wash chamber for receiving fluid from the wash chamber, a drain pump in communication with the sump, and a temperature sensor, the method comprising:

filling the sump with a liquid;

heating the liquid by activating the heating element; and draining the liquid from the sump immediately after heating the liquid, wherein the method is a stand-alone operation independent of a wash cycle of the dishwashing appliance.

6. The method of claim 5, further comprising measuring a temperature of the liquid in the sump with the temperature sensor and comparing the measured temperature of the liquid to a minimum drain temperature threshold prior to draining the liquid, wherein draining the liquid from the sump is performed after the measured temperature is equal to or greater than the minimum drain temperature threshold.

7. The method of claim 6, wherein the minimum drain temperature threshold is about one hundred twenty degrees Fahrenheit or more.

8. The method of claim 5, wherein the method is performed automatically.

9. The method of claim 5, wherein the method is performed in response to a user input.

* * * * *